US011097326B2

(12) United States Patent
Thome et al.

(10) Patent No.: US 11,097,326 B2
(45) Date of Patent: Aug. 24, 2021

(54) METHOD FOR PRODUCING OPEN-SEAM PIPES FROM SHEET METAL PANELS

(71) Applicant: SMS group GmbH, Düsseldorf (DE)

(72) Inventors: Mario Thome, Willich (DE); Manfred Kolbe, Mönchengladbach (DE); Uwe Feldmann, Mönchengladbach (DE); Jochen Vochsen, Erkelenz (DE)

(73) Assignee: SMS group GmbH, Düsseldorf (DE)

( * ) Notice: Subject to any disclaimer, the term of this patent is extended or adjusted under 35 U.S.C. 154(b) by 300 days.

(21) Appl. No.: 15/579,036

(22) PCT Filed: Jun. 2, 2016

(86) PCT No.: PCT/EP2016/062556
§ 371 (c)(1),
(2) Date: Dec. 1, 2017

(87) PCT Pub. No.: WO2016/193395
PCT Pub. Date: Dec. 8, 2016

(65) Prior Publication Data

US 2018/0169727 A1 Jun. 21, 2018

(30) Foreign Application Priority Data

Jun. 3, 2015 (DE) ..... 10 2015 210 259.9

(51) Int. Cl.
*B21D 5/01* (2006.01)
*B21D 5/10* (2006.01)
*B21D 5/02* (2006.01)

(52) U.S. Cl.
CPC ..... *B21D 5/015* (2013.01); *B21D 5/10* (2013.01); *B21D 5/02* (2013.01)

(58) Field of Classification Search
CPC ..... B21C 37/0822; B21C 37/0108; B21C 37/0815; B21D 5/015; B21D 5/10; B21D 11/203; B21D 5/12
See application file for complete search history.

(56) References Cited

U.S. PATENT DOCUMENTS 2,591,085 A * 4/1952 McCall ..... B21D 5/015 72/399
3,466,907 A * 9/1969 Landis ..... B21B 1/166 72/52

(Continued)

FOREIGN PATENT DOCUMENTS

DE 4226402 A1 * 2/1994 ..... B21C 37/0815
DE 42 15 807 C2 3/1998

(Continued)

OTHER PUBLICATIONS

Verlinden et al., Thermo-Mechanical Processing of Metallic Materials, 2007, Elsevier, First Edition, pp. 289-297 (Year: 2007).*

(Continued)

*Primary Examiner* — Adam J Eiseman
*Assistant Examiner* — Stephen Floyd London
(74) *Attorney, Agent, or Firm* — Maier & Maier, PLLC

(57) ABSTRACT

A method for producing open-seam pipes from sheet metal panels, in particular thick sheet metal panels. A sheet metal panel, having bending edges on the long sides thereof, is fed to a pipe forming press where the sheet metal panel is formed, lying on a lower tool having of two supporting elements which are horizontally spaced apart from each other, by an upper tool, which can be raised and lowered, by application of a bending force, progressively into an open-seam pipe having bending edges on opposite long sides with a gap for later longitudinal seam welding. In order that the sheet metal panel can be easily, progressively formed or shaped from the start, at least the bending sections imme- (Continued)

diately adjacent on the bending edges of the sheet metal panel are each formed from the outside to the inside, deviating from a numerically ascending bending step sequence in a pilgering process sequence.

3 Claims, 5 Drawing Sheets

(56) References Cited

U.S. PATENT DOCUMENTS

| | | | | |
|---|---|---|---|---|
| 3,605,472 | A * | 9/1971 | Saito | B21C 37/08 72/176 |
| 4,149,399 | A | 4/1979 | Persson et al. | |
| 5,642,291 | A * | 6/1997 | Prunotto | B25J 9/1671 700/117 |
| 6,098,435 | A * | 8/2000 | Takada | B21D 5/02 72/31.11 |
| 6,202,465 | B1 * | 3/2001 | Jankoski | A61B 1/00071 72/368 |
| 2004/0019402 | A1 * | 1/2004 | Bourne | B21D 5/02 700/165 |

FOREIGN PATENT DOCUMENTS

| | | | | |
|---|---|---|---|---|
| DE | 102011053676 | A1 * | 3/2013 | B21D 5/015 |
| EP | 2 529 849 | A2 | 12/2012 | |
| EP | 2529849 | A2 * | 12/2012 | B21D 5/015 |
| EP | 2694228 | B1 * | 5/2015 | |
| EP | 2 883 627 | A1 | 6/2015 | |
| FR | 2210462 | A1 * | 7/1974 | B21C 37/0815 |
| JP | 2012-170977 | A | 9/2012 | |
| WO | 2009/023973 | A1 | 2/2009 | |
| WO | WO-2012092909 | A1 * | 7/2012 | B21D 11/203 |
| WO | 2014/192091 | A1 | 12/2014 | |
| WO | WO-2016071161 | A1 * | 5/2016 | B21D 5/015 |

OTHER PUBLICATIONS

International Search Report dated Jul. 26, 2016 of corresponding International application No. PCT/ER2016/062556; (5 pp., including machine-generated English translation).

Written Opinion dated Jul. 26, 2016 of corresponding International application No. PCT/EP2016/062556; (8 pp., including machine-generated English translation).

Answer to Written Opinion dated Dec. 13, 2016 of corresponding International application No. PCT/EP2016/062556; (7 pp., including machine-generated English translation).

* cited by examiner

METHOD FOR PRODUCING OPEN-SEAM PIPES FROM SHEET METAL PANELS

FIELD

The invention relates to a method for producing open-seam pipes from sheet metal panels, in particular thick sheet metal panels, wherein a sheet metal panel having bending edges on the long sides thereof is fed to a pipe forming press, in which the sheet metal panel, lying on a lower tool consisting of two supporting elements that are horizontally spaced apart from each other, is progressively formed by an upper tool, which can be raised or lowered, by application of a bending force progressively into an open-seam pipe that has bending edges on opposite long sides with a gap for later longitudinal seam welding.

BACKGROUND

The methods employed in practice for producing pipes from sheet metal panels include the pipe forming press method with progressive shaping and bending steps on pipe forming presses. A pipe forming press or pipe bending press usually comprises, in a base frame, a lower tool, consisting of two supporting or bending elements that are arranged laterally spaced apart next to each other, and an upper tool, which can be adjusted vertically from above against the lower tool and is carried by a bending rail that can be raised and lowered and which extends over the entire length of the sheet metal panel, with which a bending force can be applied to the sheet metal panel lying on the lower tool.

For the production of a pipe or a large-diameter pipe by the progressive forming method, a plurality of successive operating steps are required. In a first step, the sheet metal panel is initially bent at the edges on the long sides thereof, usually in a separate edge bending press. The initial bending of the edges on the long sides is conducted in order that, when the sheet metal panel is deformed to an open-seam pipe, the pipe radius is uniformly shaped in the region of the later seam, namely where the edges on the long sides of the sheet metal panels that are bent to form the pipe lie opposite to each other with a gap for longitudinal seam welding. The sheet metal panel that is initially bent in such a way is then inserted into the pipe forming press and subjected there to the actual bending process. A bending force is hereby applied to the sheet metal panel by downward pressure of the upper part of the press and the sheet metal panel is thereby deformed under the action of the bending rail and the upper forming tool carried by it. This sequence is repeated a number of times until the sheet metal panel has been reshaped to the open-seam pipe.

Known from DE 42 15 807 C2 is a pipe bending or pipe forming press designed in a frame construction. The rail constructed as the bending tool is carried vertically in side stands of the frame. Said upper bending tool is fastened at piston-cylinder units so as to move cardanically to a small extent and rests via these units against the upper frame traverse. The supporting elements of the lower bending tool are carried by a platform, which is likewise supported by piston-cylinder units, which act coaxially to the upper piston-cylinder units. The piston-cylinder units that act against one another are intended to prevent any sagging of the platform, even though the lower frame traverse should bend under the operating load of the press. For this purpose, more or less pressure is applied to individual piston-cylinder units.

In particular during the shaping of thick-walled pipes of small diameter on pipe forming presses by the so-called JCO process, in which, starting at a lengthwise or bending edge of the sheet metal panel, a first semicircular shape, the "J," is bent and subsequently the sheet metal panel that has been bent initially in such a way is shifted in place by a manipulator such that, starting with the other lengthwise or bending edge, the sheet metal panels are shaped into a "C," as a result of which the second semicircular shape results, and finally formed into an "O," a horizontally required large separation between the supporting and bending elements of the lower tool, which are arranged next to each other, has proven problematic.

At the start of the bending operation with successively ensuing bending steps, the sheet metal panel lies flat on one of the supporting or bending elements, while a lengthwise or bending edge rests on the other supporting or bending element with only small overlap, so that, when the bending force is applied by the bending rail, this lengthwise or bending edge can slip off the supporting or bending element and accordingly the bending process must be terminated.

SUMMARY

The invention is therefore based on the object of creating a method of the kind mentioned in the beginning, but without the described drawbacks, so that the sheet metal panel can be reshaped or shaped progressively without problem.

This object is achieved in accordance with the invention in that at least the bending sections immediately adjacent from outside to inside on the bending edges of the sheet metal panels are reshaped in the pilgering process deviating from a numerically ascending bending step sequence. This procedure for reshaping or shaping sheet metal panels does not begin with the first bending section following the bending edge, but rather the first bending step takes place in the second bending section. Subsequently, the first bending section and afterwards the fourth bending section and subsequently the third bending section and so forth are reshaped. As a result, it is advantageously achieved that, at the start of the bending operation, no longer only the bending edge, but, beyond it, at least one length part or width part of the first bending section rests on a supporting element of the lower tool, while, lying horizontally opposite to it, the sheet metal panel is carried unchanged by the other supporting element. Accordingly, depending on the bending step width over the bending sections adjacent to the upper tool on both sides, a nearly symmetric support of the sheet metal panel in the effective region of the upper tool on the supporting elements of the lower tool can be achieved. Any slipping or pushing away of the sheet metal panel, which then rests with adequate overlap, namely of the bending edge and the first bending section, on the supporting element, is accordingly effectively prevented at the start of the reshaping or shaping operation. A further advantage is that a larger lower tool separation distance and thus correspondingly smaller reshaping forces can be realized.

Once a first semicircular shape of the sheet metal panel has been produced in accordance with the above-described procedure, the sheet metal panel is shifted on the supporting elements so far that, starting with the second bending step, the second semicircular shape of the sheet metal panel is bent at the other, opposite-lying bending edge in accordance with the pilgering process explained above.

A preferred measure in accordance with the invention provides that, for carrying out the second bending step, which follows the first bending step performed in the second bending section, for reshaping of the first bending section, the sheet metal panel is retracted laterally and initially positioned at an steep angle between the lower tools with the bending edge resting on one of the supporting elements. Through initial bending of the sheet metal panel by the leading first bending step at a distance from the lengthwise or bending edges in the second bending step, it is possible to achieve a relatively steep positioning of the sheet metal panel between the supporting elements, so that, for the subsequent first bending step, the bending edge rests on a supporting element with adequately large overlap and can no longer slip off.

An advantageous proposal of the invention provides that, at least in one bending step, once on the left side and once on the right side in relation to the predetermined middle of the upper tool punching from the longitudinal axis into the progressively formed sheet metal panel, a lesser shaping is performed in comparison to the other bending steps and that, in conclusion, through application of a pressing force from the outside acting on this non-round preform, in each case specifically in the lesser shaped areas previously formed on both sides of the middle, the finished open-seam pipe is shaped. Accordingly, through the intentional production of an initially tailor-made non-round preform with sections of lesser shaping—for example, with a bending of 12° instead of a bending of 24°—it is possible to form an open-seam pipe geometry, which is to the greatest extent circular, with minimal open seam.

Furthermore, through the lesser shaping or the reduction in the depth of pressing in sections, it is achieved that, when the sheet metal panel is shaped to an open-seam pipe by the pilgering process in accordance with the invention, the bending edges do not collide with the upper tool or bending rail, which can be raised and lowered, during, in each case, the last bending steps for production of the first semicircular form and the second semicircular form.

BRIEF DESCRIPTION OF THE FIGURES

Further features and details of the invention ensue from the claims and from the following description of an exemplary embodiment of the invention illustrated in the drawings. Shown are:

FIG. 5A a post-forming or reshaping of a non-round preform in at least two-pressing or bending steps, namely, in a first bening step, through application of force on the non-round preform on the left next to the open seam or gap FIG. 5B a second step after rotation of the non-round preform, in a second bending step through application of force on the right next to the open seam or gap

DETAILED DESCRIPTION OF THE FIGURES

Figure 1A:
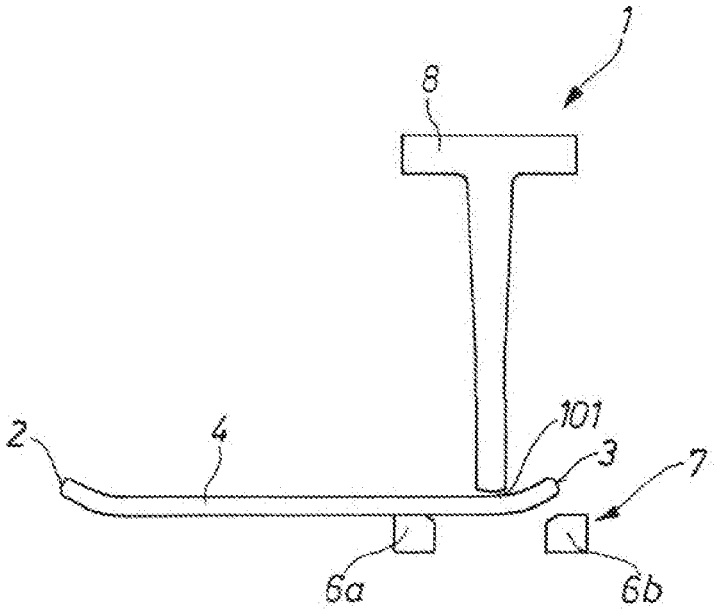
FIG. 1A in a schematic manner, the start of the shaping of a sheet metal panel according to the prior art on a pipe forming press, proceeding from top to bottom with the initially positioned sheet metal panel FIG. 1B in a schematic manner, the application of the bending force by a bending rail FIG. 1C in a schematic manner, the rising bending rail after the application of force FIG. 2A in a schematic manner, the start of the shaping of a sheet metal panel by the pilgering process, starting with the second bending section on a pipe forming press, proceeding from top to bottom with the initially positioned sheet metal panel FIG. 2B in a schematic manner, the application of the bending force by the bending rail FIG. 2C in a schematic manner, the rising bending rail after the application of force FIG. 3A in a schematic manner, the further shaping of the sheet metal panel with the second bending step, which now follows the first bending step and occurs subsequently in the first bending section, on the pipe forming press, proceeding from top to bottom with the sheet metal panel initially positioned at a steep angle FIG. 3B in a schematic manner, the application of the bending force by the bending rail FIG. 3C in a schematic manner, the rising bending rail after the application of force FIG. 4 a schematically illustrated open-seam pipe showing the bending steps and bending sections in accordance with the pilgering process.
Figure 1B:
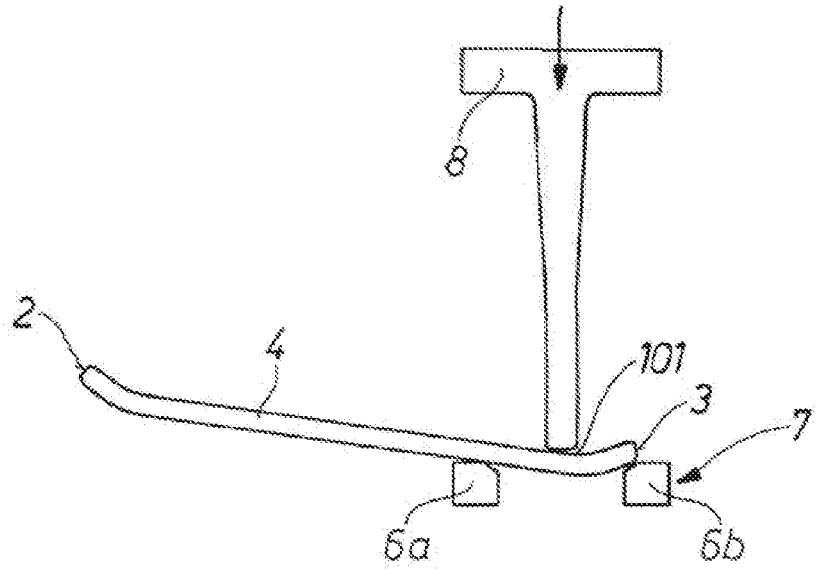
Figure 1C:
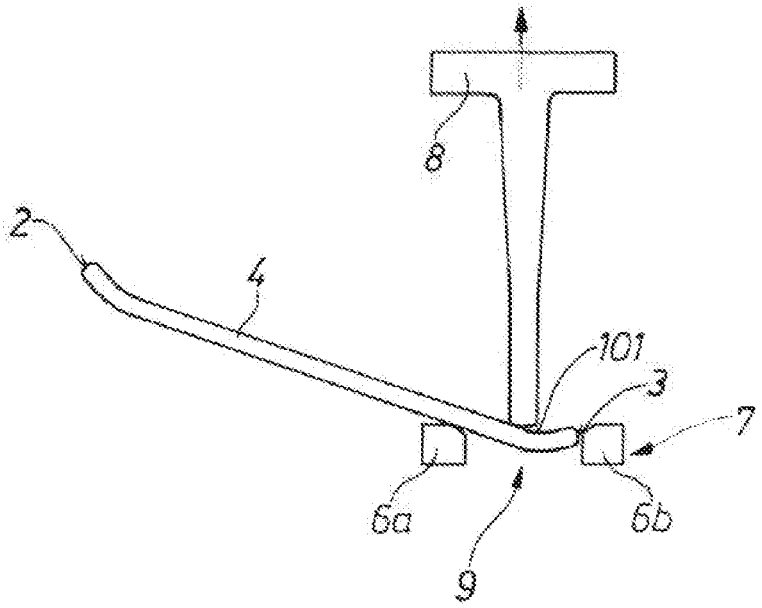

According to FIG. 1, on a pipe forming press 1, which has long been known as such, a sheet metal panel 4, provided with bending edges 2, 3 on the long sides thereof, is shaped or reshaped into a finished open-seam pipe. For support of the sheet metal panel 4 during the reshaping operation, a lower tool 7, consisting of two supporting elements 6*a*, 6*b*, which are horizontally spaced apart, is provided, with the reshaping force being applied by a bending rail 8 that can be raised and lowered. At the start of the reshaping operation, the sheet metal panel 4 is positioned in relation to the bending rail 8 in such a way that, during the first reshaping or bending step, the reshaping force exerted by means of the bending rail 8 acts on the first bending section 101 that follows the bending edge 3, with the bending edge 3 being pressed against the supporting element 6*b*. Through only a small support surface of the bending edge 3 on the supporting element 6*b*, the bending edge 3 or the sheet metal panel 4 can slip off the supporting element 6*b* into the clearance 9 between the supporting elements 6*a* and 6*b*, as illustrated in FIG. 1*c*, after which the reshaping operation has to be terminated.

Figure 2A:
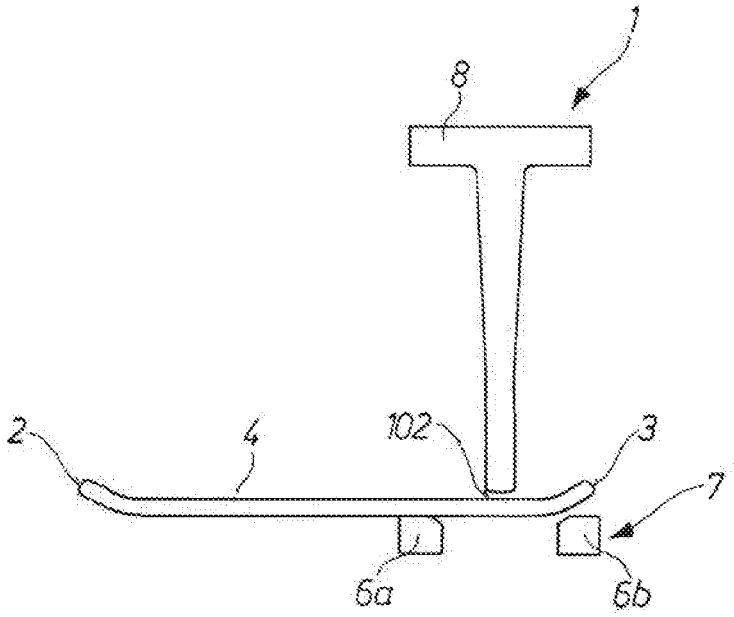
Figure 2B:
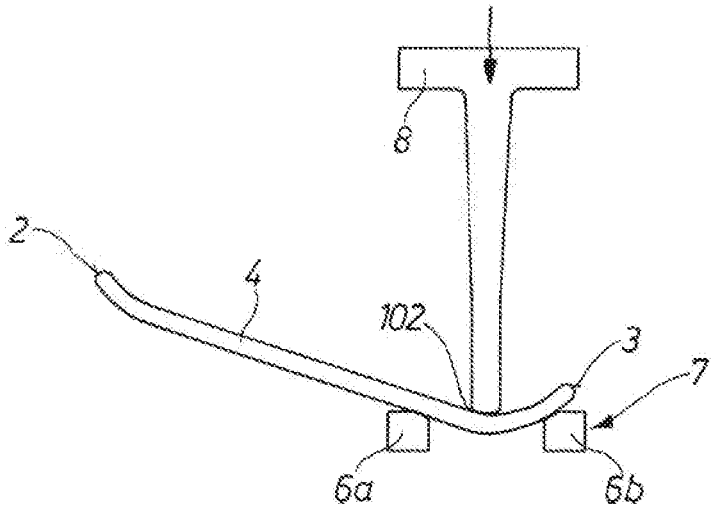
Figure 2C:
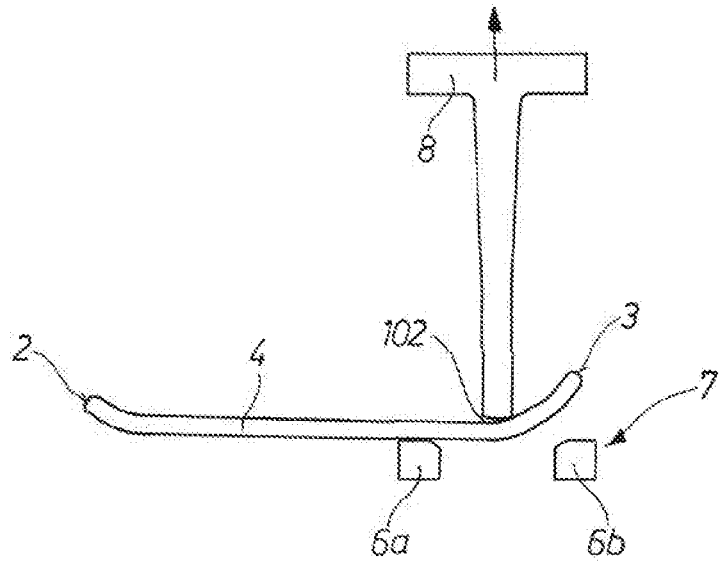
Figure 3A:
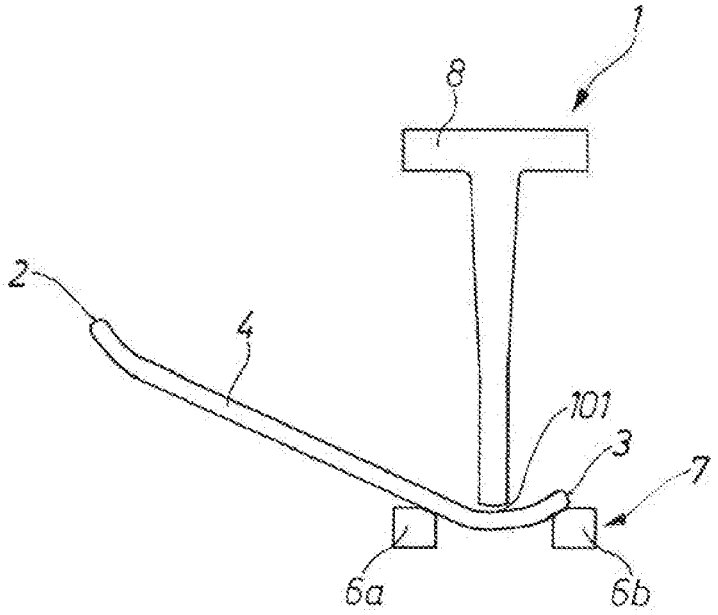
Figure 3B:
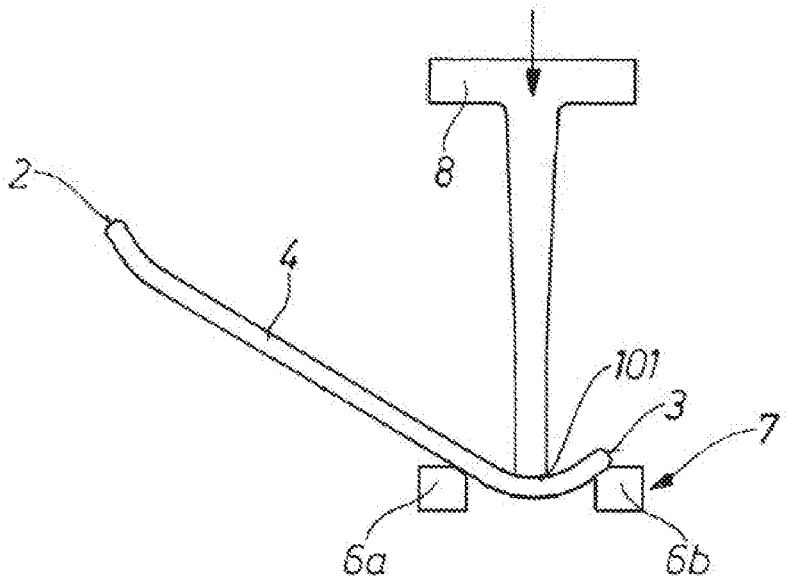
Figure 3C:
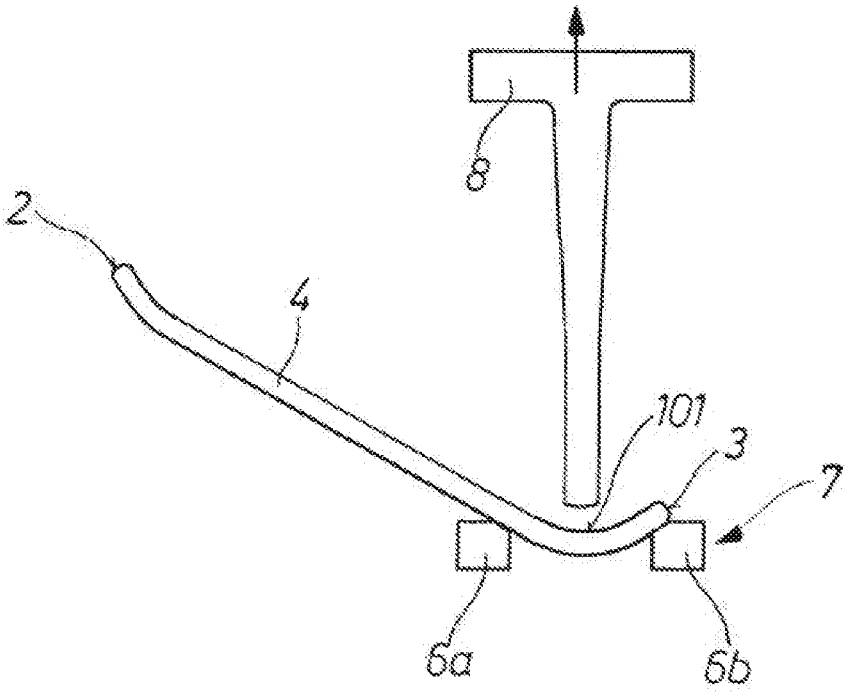

The reshaping of a sheet metal panel 4 into an open-seam pipe 5 in accordance with FIGS. 2 and 3 is carried out in the pilgering process. With reference to the exemplary bending sections 101 to 106 and 107 to 112 as well as 113 of the open-seam pipe 5 in FIG. 4, the first reshaping or bending step is accordingly carried out in the second bending section 102 that follows the bending edge 3. The bending edge 3, extended by the width of the first bending section 101, is pressed with an adequately large support surface against the supporting element 6*b* and accordingly cannot slip off during the reshaping operation.

For the subsequent bending step, the sheet metal panel is moved laterally to the left by a manipulator, for example, and initially positioned at a steep angle between the supporting elements 6*a*, 6*b* on the supporting element 6*b* with adequate support surface of the bending edge 3 owing to the already reshaped or initially bent second bending section 102. During the second reshaping or bending step, the bending force exerted by means of the bending rail 8 then acts on the first bending section 101 following the bending edge 3 (compare FIGS. 3 and 4 for this).

During the following reshaping or bending steps, the pilgering process can be employed further, whereby the subsequent bending steps then occur in accordance with the sequence of the bending steps 104, 103, 106, 105 for the first or right-side semicircle 10 of the open-seam pipe 5 (see FIG. 4 for this).

For reshaping of the second or left-side semicircle 11 of the open-seam pipe 5, the sheet metal panel 4 is positioned with the bending edge 2 on the supporting element 6*a* and the bending steps are then carried out in the pilgering process analogously to the already described reshaping of the first semicircle 10 in the sequence, but in the bending sections 108, 107, 110, 109, 112, 111, 113 (see FIG. 4 for this).

In the bending sections 105 and 111, for example, it is possible specifically to carry out a lesser bending of the sheet metal 4 in the remaining bending sections. As a result of this, two regions 12*a*, 12*b*, which are less shaped in correspondence to the respective bending step, are present in a defined manner, as illustrated in FIGS. 5A and 5B, so that a non-round, albeit tailor-made preform 13 for the finished reshaping, is obtained.

As shown in FIGS. 5A and 5B, the pressing force for production of the finished open-seam pipe 5, which is to the greatest extent circular as possible, is applied via the bending rail 8 from the outside onto the non-round preform 13.

For this purpose, the non-round preform 13 is positioned in such a way that the region 12*a*, which lies on the left next to the open seam or gap 14 and is less shaped, is situated at a nine o'clock position, as illustrated in FIG. 5A.

The sequences of this first pressing step of the bending are illustrated in FIG. 5A, proceeding from left to right with the positioned non-round preform 13, the application of the pressing force by the bending rail 8, and the bending rail 8 raised after the application of force.

The second pressing step of the bending is illustrated in FIG. 5B in the same sequence as before. For optimization of the bending torque, the non-round preform 13—here, in its unchanged semicircle 10 on the right—is positioned in such a way that the lesser shaped area 12*b* on the right next to the open seam or gap 14 assumes a three o'clock position. The pressing force now applied by the bending rail 8 to this side of the preform 13 then brings the non-round preform 13 into the final form of the finished open-seam pipe 5, which is to the greatest extent circular, with a small open seam or gap 14 (FIG. 5B, figure on right) being thereby achieved.

The invention claimed is:

1. A method for producing open-seam pipes from sheet metal panels, comprising:

provision of a sheet metal panel having bending edges on the long sides thereof;

feeding the sheet metal panel to a pipe forming press in which the sheet metal panel is positioned on a lower tool, wherein the lower tool comprises two supporting elements which are horizontally spaced apart from each other; and progressively forming the sheet metal panel with an upper tool, which can be raised and lowered by application of a bending force, into an open-seam pipe having bending edges on opposite long sides thereof, wherein the open-seam pipe comprises a gap for later longitudinal seam welding, wherein at least two bending sections are reshaped in a pilgering process sequence, each of the two bending sections having an outside corresponding to each of the bending edges and an inside corresponding to a center of the sheet metal panel such that the two bending sections lie adjacent to each other, wherein the pilgering process sequence comprises:

identifying a series of bends to be performed on each of the two bending sections, the series of bends to be performed comprising at least a first point, a second point, a third point, and a fourth point, each arranged in numerically ascending order from the outside to the inside of each bending section;

performing a bending operation according to a pattern defined by bending the second point first, the first point second, the fourth point third, the third point fourth, in a continuous process, until the series of bends is complete.

2. The method according to claim 1, wherein for carrying out a second bending step for reshaping each of the first points, which follows a first bending step performed at each of the second points, the sheet metal panel is retracted laterally and initially positioned at a non-level angle between the lower tool with support of the respective bending edge on one of the corresponding supporting elements.

3. The method according to claim 1, wherein, as the sheet metal panel is progressively formed, a lesser shaped region is produced once each on a left semicircle and a right semicircle of the sheet metal panel relative to a longitudinal axis of the sheet metal panel, the lesser shaped regions resulting in a non-round form of the sheet metal panel;

wherein the method further comprises a finishing step in which the upper tool presses upon the non-round form from an exterior of the non-round form and finishes shaping each of the lesser shaped regions to produce the open-seam pipe.

* * * * *